United States Patent [19]

Kimmel

[11] Patent Number: 4,634,162

[45] Date of Patent: Jan. 6, 1987

[54] PORTABLE PORTAL LOCK

[76] Inventor: Dale O. Kimmel, P.O. Box 139, Eureka, Mont. 59917

[21] Appl. No.: 713,296

[22] Filed: Mar. 18, 1985

[51] Int. Cl.[4] ..... E05C 17/54

[52] U.S. Cl. ..... 292/343; 190/100; 292/DIG. 15; 292/288

[58] Field of Search ..... 190/41 R, 100; 292/244, 292/342, 343, 216, 218, DIG. 15, 213, 288, 258

[56] References Cited

U.S. PATENT DOCUMENTS

| | | | |
|---|---|---|---|
| 201,383 | 3/1878 | Beecher | 292/218 |
| 285,919 | 10/1883 | Outhwaite | 292/218 |
| 343,298 | 6/1886 | Conn | 292/DIG. 15 X |
| 718,673 | 1/1903 | Swanburg . | |
| 929,287 | 7/1909 | Collins . | |
| 932,694 | 8/1909 | Fulton et al. . | |
| 1,375,769 | 4/1921 | Bleackacek . | |
| 2,635,718 | 4/1953 | Birkemeier | 292/280 X |
| 2,798,755 | 7/1957 | Zapotocny | 292/342 |

*Primary Examiner*—Richard E. Moore

*Attorney, Agent, or Firm*—Wood, Dalton, Phillips, Mason & Rowe

[57] ABSTRACT

A portal lock is provided having an arm securable to a portable case and rotatably supporting a wedge member having four outwardly radiating legs. The legs are eccentric to and at substantially equal spacing about the axis of rotation of the wedge member.

7 Claims, 8 Drawing Figures

FIG. 4
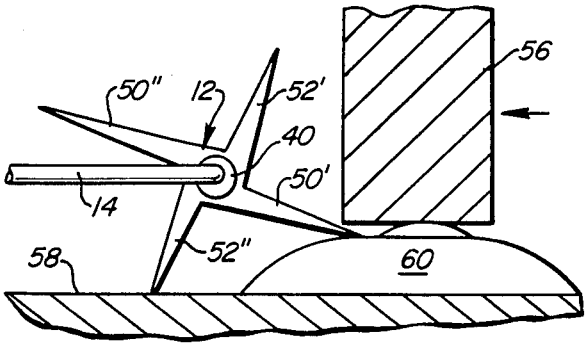
FIG. 6
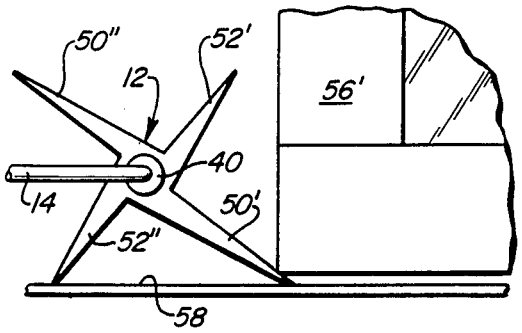
FIG. 5A
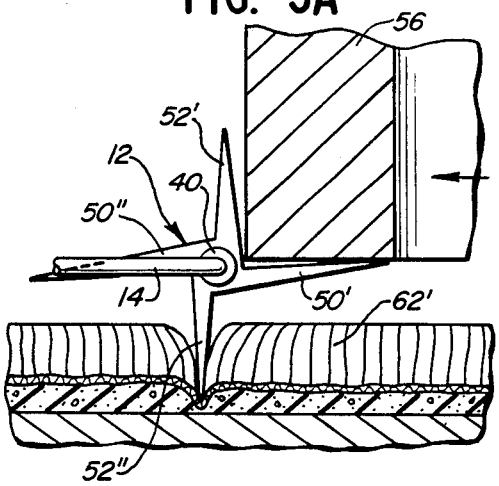
FIG. 5B
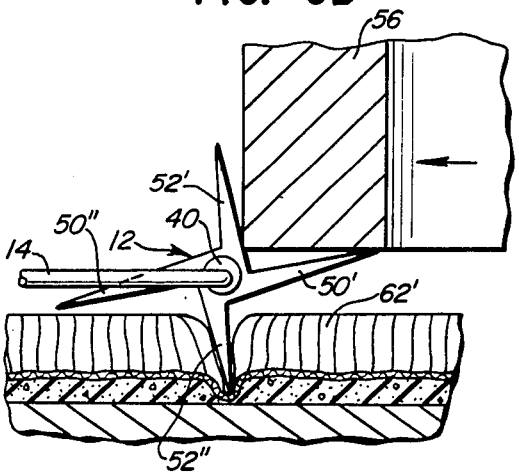
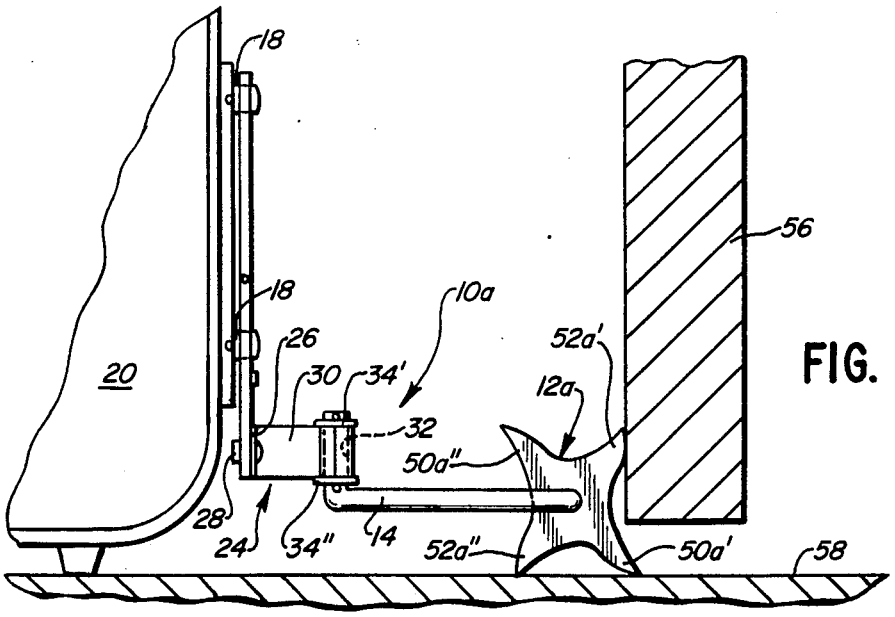
FIG. 7

PORTABLE PORTAL LOCK

BACKGROUND OF THE INVENTION

1. Technical Field

The present invention relates to a portal lock and more particularly to a portable portal lock for use by travelers.

2. Background Art

Various wedging devices for use by travelers in securing doors or windows in addition to the normal permanent locks on such portals have been known in the art. Such devices are disclosed in, for example, U.S. Pat. Nos. 932,694, 929,287 and 718,673.

The prior art wedging devices are not however usable in all of the various door constructions which may be encountered by a traveler, a significant disadvantage in view of the numerous different types of construction which may be encountered today (e.g. various height thresholds, high doors without thresholds, various thicknesses of carpets, etc.). Such wedging devices have further provided only limited security inasmuch as a potential intruder in many instances can easily slip something beneath the door to knock the wedging device away. In addition, the wedging devices often allow the door to be opened a small gap through which an intruder can reach to knock the wedging device away.

The present invention is directed toward overcoming one or more of the problems as set forth above.

SUMMARY OF THE INVENTION

In one aspect of the present invention, a portal lock is provided having an arm securable to a portable case and rotatably supporting a wedge member having four outwardly radiating legs. The legs are at substantially equal spacing about the axis of rotation of the wedge member. In another aspect of the present invention, the legs are V-shaped and eccentric to the wedge member axis of rotation.

The present invention provides security for travelers against intruders in addition to any security which may be provided by the permanent door and window locks. Further, the present invention provides a wedge member which cannot be knocked free by an intruder slipping something under the door or reaching around a small gap in the doorway. Still further, the present invention is readily adaptable for use in virtually any door configuration which may be encountered by the traveler.

BRIEF DESCRIPTION OF THE DRAWINGS

FIGS. 4, 5A and 5B show the portal lock of FIG. 1 in position to lock various different types of doors;

FIG. 6 shows the portal lock locking a sliding door or window; and

FIG. 7 shows an alternative embodiment of the portal lock.

DESCRIPTION OF THE PREFERRED EMBODIMENTS

Figure 1:
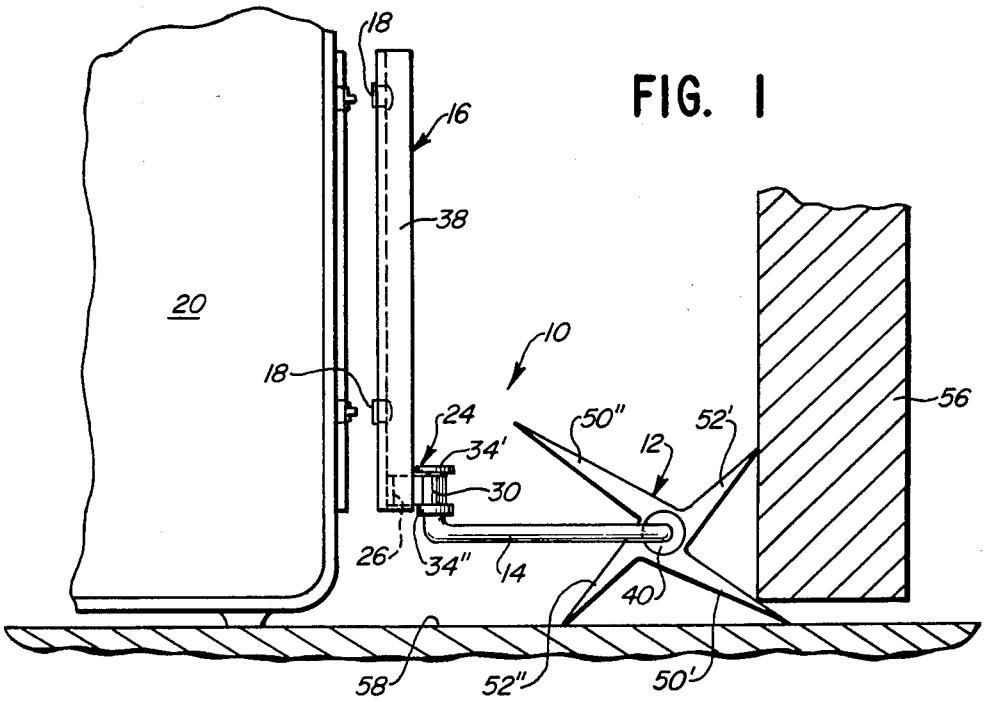
FIG. 1 illustrates the portal lock of the present invention positioned to lock a closed door.
Figure 2:
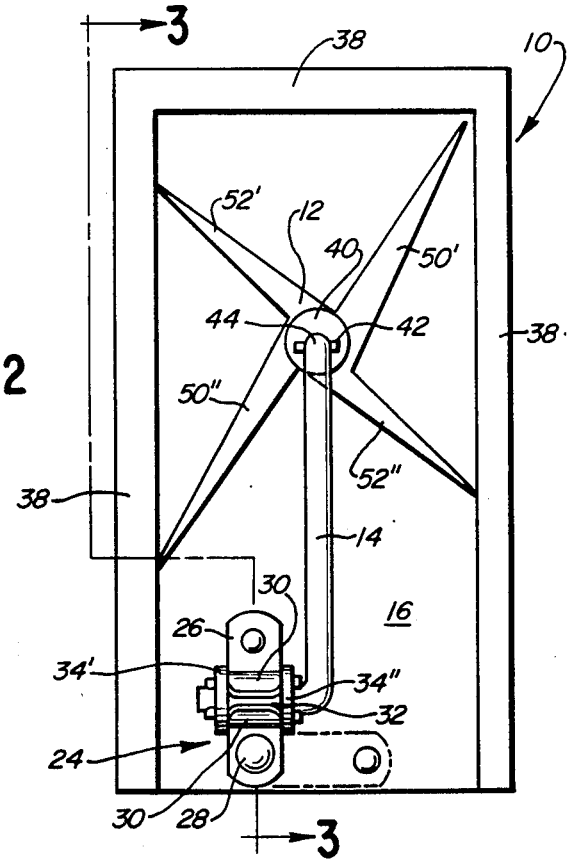
FIG. 2 is a view of the portal lock in its stored position.
Figure 3:
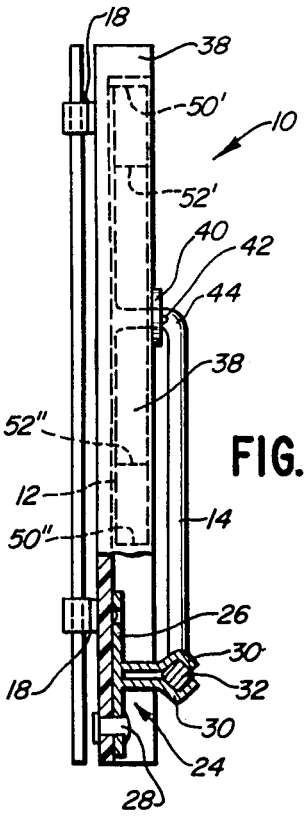
FIG. 3 is a view taken along line 3—3 of FIG. 2.

One embodiment of the portal lock 10 is illustrated in FIGS. 1–6, and in particular in FIGS. 1–3. The lock 10 includes a wedge member 12 rotatably supported on a support arm 14 which is connected to a mounting plate 16. The mounting plate 16 includes suitable structure, such as the snaps 18 shown, enabling the mounting plate 16 to be removably attached to the portable case 20 such as a piece of travel luggage.

A universal type connection 24 is provided between the mounting plate 16 and support arm 14 so that the wedge member 12 may be appropriately positioned for either locking (FIGS. 1 and 4–6) or storage (FIGS. 2 and 3). One suitable such connection is shown in FIGS. 1–3 and includes a base bracket 26 secured to the mounting plate 16 by a suitable pivot pin 28. The bracket 26 pivots about the pin 28 between a storage position (shown in FIG. 2) and a locking position (shown in phantom in FIG. 2).

The bracket 26 includes a pair of facing fingers 30 which grasp a short section 32 of the support arm 14. A pair of collars 34',34" are suitably secured to the arm section 32 on either side of the fingers 30 to secure the section 32 against sliding out from between the fingers 30, Preferably, the short arm section 32 has a square cross section as shown in FIG. 3 and the fingers 30 are somewhat flexible so that the arm 14 will be pivotable between two positions spaced at 90°, and the fingers 30 will positively hold the arm 14 in either of those positions.

A suitable pouch (not shown) may also be provided to carry and protect the lock 10 in its storage position. The mounting plate 16 includes a peripheral edge 38 which extends about the wedge member 12 when the lock 10 is disposed in its storage position. Since the pouch may be made of inexpensive cloth material, the edge 38 serves to protect it from snagging on the wedge member 12. The edge 38 also will prevent clothes from snagging on the wedge member 12 should the hlock 10 be packed in the case 20 during travel.

To limit the bulk of the portal lock 10 (an important consideration to travelers who will be carrying the lock 10 in their luggage), the peripheral edge may be extended outwardly so as to cover only the wedge member 12, with the support arm 14 (which has no sharp edges) projecting outwardly from the confines of the housing 16.

The wedge member 12 is suitably secured to the end of the support arm 14 for rotation about the arm end. A collar 40 is preferably secured to the arm end by a suitable pin 42 to support the wedge member 12 clear of the elbow 44 in the arm 14 (to prevent the wedge member 12 from becoming jammed on the elbow 44 with rotation thereby hindered).

The wedge member 12 includes four legs 50',50", 52',52" disposed eccentrically about the center of the wedge member 12. Each leg has substantially the same configuration as the leg extending opposite it, with one pair of oppositely extending legs 50',50" being longer than the other such pair of legs 52',52". The leg pairs 50',50" and 52',52" are also disposed such that a line between their ends would pass through the axis of rotation of the wedge member 12.

The wedge member 12 is thus adaptable for use with a large number of portal configurations. The wedge member 12 may lock a door 56 supported above a hard floor 58 by wedging one of the long legs 50' beneath the door 56 such as shown in FIG. 1. If an intruder attempts to push the door 56 in, the door 56 will jam against the front two legs 50',52' of the wedge member 12, causing the rear short leg 52" to dig into the floor 58 and block further opening of the door 56. Further, due to the stability provided by the support arm 14 and attached case 20, an intruder would be unable to dislodge the wedge member 12 by reaching under the door 56 or, even should the lock 10 permit the door 56 to be opened a small gap before jamming, by reaching through such a gap.

It is also apparent from an examination of FIG. 1 that if the door 56 were supported above the floor 58 a greater distance than that shown, the wedge member 12 would serve to lock the door 56 better by locating one of the short legs 52' beneath the door 56 with one of the long legs 50' extending rearwardly and jammed into the floor 58.

Three legs (e.g. legs 50',52',52'' in FIG. 1) may often function in locking a door 56 as discussed above but, depending on the door construction, either two short legs 52',52'' and one long leg 50' or two long legs 50',52'' and one short leg 52' may be required. Thus, the wedge member 12 disclosed having four legs 50',50'',52', 52'' disposed eccentric to and at substantially equal spacing about its center is particularly well suited for use with virtually any door construction which the traveler might encounter.

FIGS. 4–6 illustrate still further the adaptability of the present lock 10 for use with a wide variety of door constructions. In FIG. 4, the wedge member 12 is positioned to lock a door 56 supported over a raised threshold 60. Depending on the height of the bottom of the door 56, either one of the long or short legs 50',52' may be wedged between the threshold 60 and the door 56 such as previously discussed.

The lock 10 may also be used in locations where the floor is covered with deep carpeting 62 such as shown in FIGS. 5A and 5B. Where the carpet 62 is relatively full (supporting the case 20 and support arm 14 relatively high above the carpet 62), the wedge member 12 may be positioned to lock the door 56 as shown in FIG. 5A. If an intruder were to attempt to open the door in FIG. 5A, the door 56 would be jammed by the lower leg 52'' which digs into the carpet fabric and mat. A similar type of door jamming would occur with thinner carpets 62' which support the case 20 and support arm 14 relatively low above the carpet 62' such as illustrated in FIG. 5B.

As illustrated in FIG. 6, the wedge member 12 may also be positioned to lock sliding doors 56' or the like. By removably mounting the wedge member 12 on the support arm 14, the lock may also be used to lock sliding windows by placing the wedge member 12 in the sliding window in a position similar to that shown in FIG. 6, and may lock vertically opening windows by locating the wedge member 12 above the window pane.

With the above embodiment, the traveler will be provided with a lock 10 which will provide security for him in his hotel room or the like no matter what the door construction. Further, the lock 10 is anchored against dislodging from the door not only by the wedging action but also by the bulk of the travel case 20 to which it is secured. This latter anchoring is important not only in securing against forces applied to the door 56, but also against forces applied directly to the wedge member 12 if the intruder slides something beneath the door or if he reaches around the door (should he manage to open a small gap).

FIG. 7 illustrates a second embodiment of the lock **10*a* having a modified wedge member 12*a* with thicker legs 50*a*',50*a*'', 52*a*', 52*a*''. With this embodiment, the wedge member 12*a* may be slightly more difficult to position in some door constructions than the first described embodiment. Due to the increased thickness of the legs 50*a*',50*a*'',52*a*',52*a*'' however, the wedge member 12' may be manufactured of lighter weight materials than the first embodiment without sacrificing strength. Inasmuch as the traveler must carry the lock 10' in his case 20**, this reduced weight construction may be preferred by some travelers.

Other aspects, objects and advantages of the invention may be obtained from a study of the drawings, specification and appended claims.

I claim:

1. A portable portal lock, comprising:

a support arm adapted for securing to a portable case; and a wedge member rotatably secured to the arm, said wedge member having four legs radiating outwardly from said support arm at substantially equal spacing from one another;

wherein one pair of said legs projecting substantially opposite one another are longer than the other pair of oppositely projecting legs.

2. The portal lock of claim 1, further comprising:

a mounting plate adapted to secure to one side of a portable case; and a universal connection between said mounting plate and said arm whereby said arm may be pivoted to move the wedge member between an operative locking position and a storage position against the mounting plate.

3. A portable portal lock, comprising a wedge member having four V-shaped legs extending outwardly from a center and at substantially equal spacing about said center, one pair of said legs projecting substantially opposite one another being longer than the other pair of oppositely projecting legs, and each pair of said legs adjacent one another being adapted to lock a portal with one of said adjacent legs supporting the other adjacent leg at an angle blocking the portal from opening.

4. The portal lock of claim 3, further comprising means for rotatably supporting the wedge member at the center of the circle.

5. The portal lock of claim 4, wherein the supporting means includes an arm secured to a piece of luggage and rotatably connected to the wedge member.

6. A portable door lock, comprising:

a mounting plate adapted to secure to one side of a piece of luggage;

a support arm adapted for securing to the plate;

a universal connection between said mounting plate and said arm whereby said arm may be pivoted to move the wedge member between an operative locking position and a storage position against the mounting plate; and a wedge member rotatably secured to the arm, said wedge member having four V-shaped legs disposed eccentrically to a circle centered on the axis of rotation and at substantially equal spacing about said axis.

7. The door lock of claim 6, wherein one pair of said legs projecting substantially opposite one an other are longer than the other pair of oppositely extending legs.

* * * * *